US010344982B2

(12) United States Patent
Berry

(10) Patent No.: US 10,344,982 B2
(45) Date of Patent: Jul. 9, 2019

(54) COMPACT MULTI-RESIDENCE TIME BUNDLED TUBE FUEL NOZZLE HAVING TRANSITION PORTIONS OF DIFFERENT LENGTHS

(71) Applicant: General Electric Company, Schenectady, NY (US)

(72) Inventor: Jonathan Dwight Berry, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 231 days.

(21) Appl. No.: 15/395,339

(22) Filed: Dec. 30, 2016

(65) Prior Publication Data

US 2018/0187603 A1 Jul. 5, 2018

(51) Int. Cl.

| | |
|---|---|
| ***F23R 3/28*** | (2006.01) |
| ***F23R 3/32*** | (2006.01) |
| ***F23D 14/62*** | (2006.01) |

(52) U.S. Cl.

CPC ..... *F23R 3/286* (2013.01); *F23D 14/62* (2013.01); *F23R 3/28* (2013.01); *F23R 3/283* (2013.01); *F23R 3/32* (2013.01)

(58) Field of Classification Search

CPC .. F23R 3/286; F23R 3/283; F23R 3/28; F23R 3/32; F23R 3/34; F23R 3/343; F23R 3/346; F23D 14/62; F23D 14/64; F23D 11/40; F02C 7/222; F02M 61/14

See application file for complete search history.

(56) References Cited

U.S. PATENT DOCUMENTS

| | | | |
|---|---|---|---|
| 8,322,143 | B2 | 12/2012 | Uhm et al. |
| 8,733,108 | B2 | 5/2014 | Kim et al. |
| 8,865,516 | B2 | 11/2014 | Uhm et al. |
| 8,904,798 | B2 | 12/2014 | Manoharan et al. |
| 8,925,324 | B2 | 1/2015 | Berry et al. |
| 8,966,909 | B2 | 3/2015 | Crothers et al. |
| 9,032,704 | B2 | 5/2015 | Crothers et al. |
| 9,134,030 | B2 | 9/2015 | Bathina et al. |
| 9,151,502 | B2 | 10/2015 | Crothers et al. |
| 9,163,839 | B2 | 10/2015 | Westmoreland et al. |
| 9,188,335 | B2 | 11/2015 | Uhm et al. |
| 9,212,822 | B2 | 12/2015 | Berry et al. |
| 9,255,711 | B2 | 2/2016 | Crothers et al. |
| 9,341,376 | B2 | 5/2016 | Westmoreland et al. |

(Continued)

*Primary Examiner* — William H Rodriguez
*Assistant Examiner* — Thomas P Burke
(74) *Attorney, Agent, or Firm* — Frank A. Landgraff

(57) ABSTRACT

A fuel nozzle includes a first plate, a second plate axially spaced from the first plate, a shroud extending between the first plate and the second plate, thereby defining a plenum. Tubes extend through the first plate, the plenum, and the second plate. An inlet of each tube is defined through the first plate, and an outlet of each tube is located downstream of the second plate. The tube inlets have a first size, the tube outlets have a second size different from the first size, and the walls defining the tubes have a transition portion between the inlet and the outlet. The transition portion has an axial length from the fuel injection port to a location having a diameter of the second size. The transition portion of a first tube extends a first axial length and the transition portion of a second tube extends a different second axial length.

18 Claims, 8 Drawing Sheets

(56) References Cited

U.S. PATENT DOCUMENTS

| | | | | |
|---|---|---|---|---|
| 9,518,742 | B2 | 12/2016 | York et al. | |
| 2011/0057056 | A1* | 3/2011 | Ziminsky | F23D 14/48 239/398 |
| 2011/0113783 | A1* | 5/2011 | Boardman | F23C 13/06 60/723 |
| 2012/0079829 | A1* | 4/2012 | Berry | F23R 3/286 60/772 |
| 2012/0180487 | A1* | 7/2012 | Uhm | F23D 14/62 60/737 |
| 2014/0157779 | A1* | 6/2014 | Uhm | F23R 3/286 60/725 |
| 2014/0260299 | A1 | 9/2014 | Boardman et al. | |
| 2015/0167984 | A1* | 6/2015 | Bellino | F23R 3/286 60/737 |

* cited by examiner

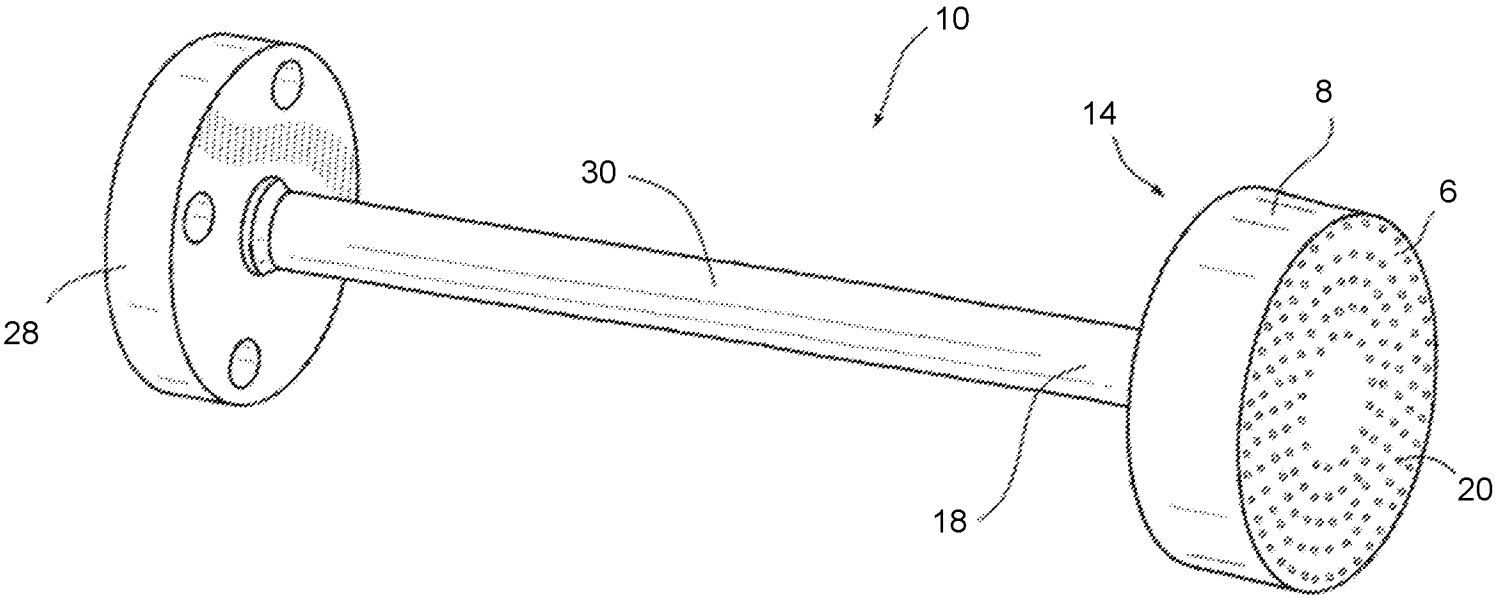
-- FIG. 1 –

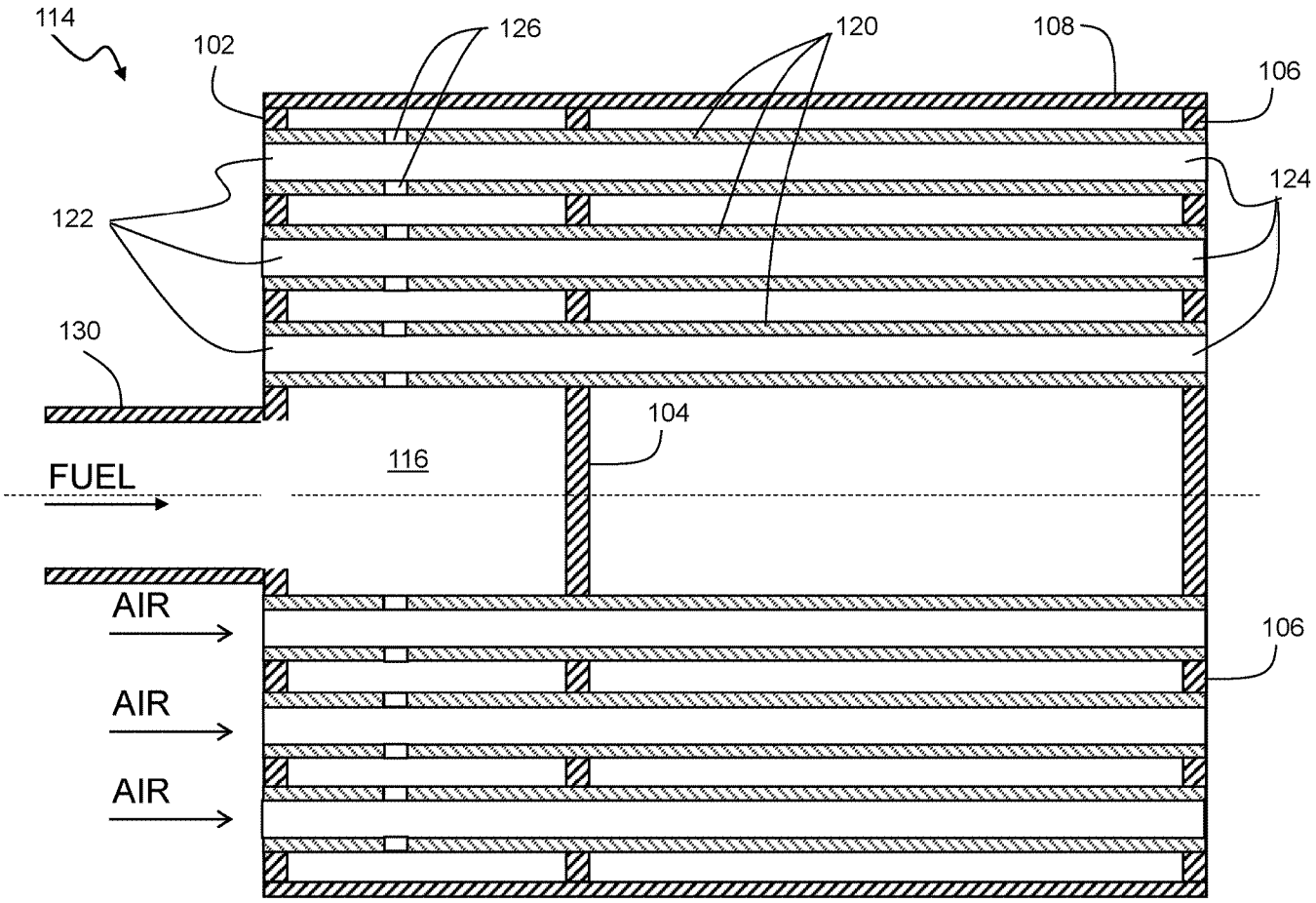
-- FIG. 2 –
*PRIOR ART*

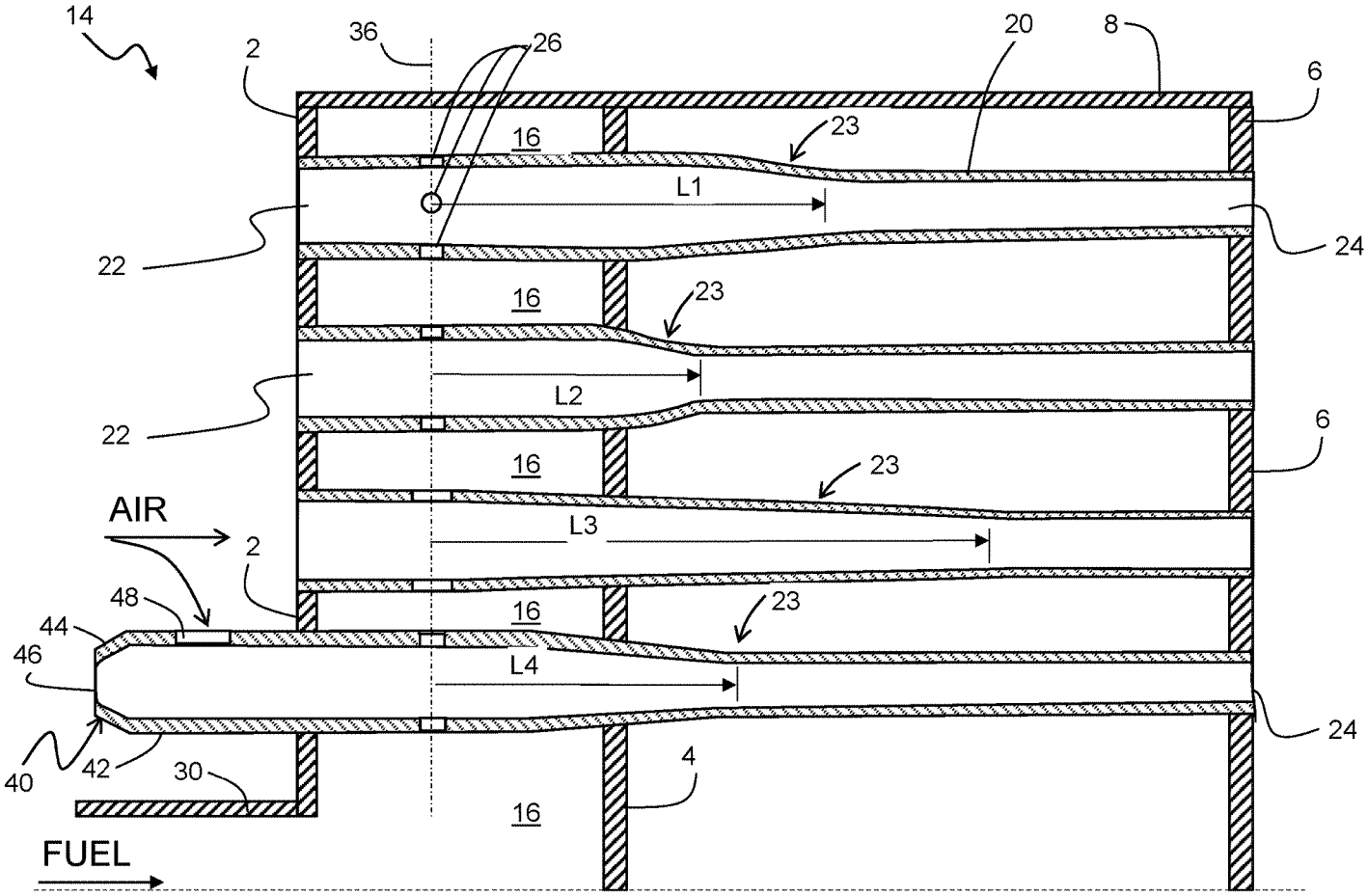
-- FIG. 3 --

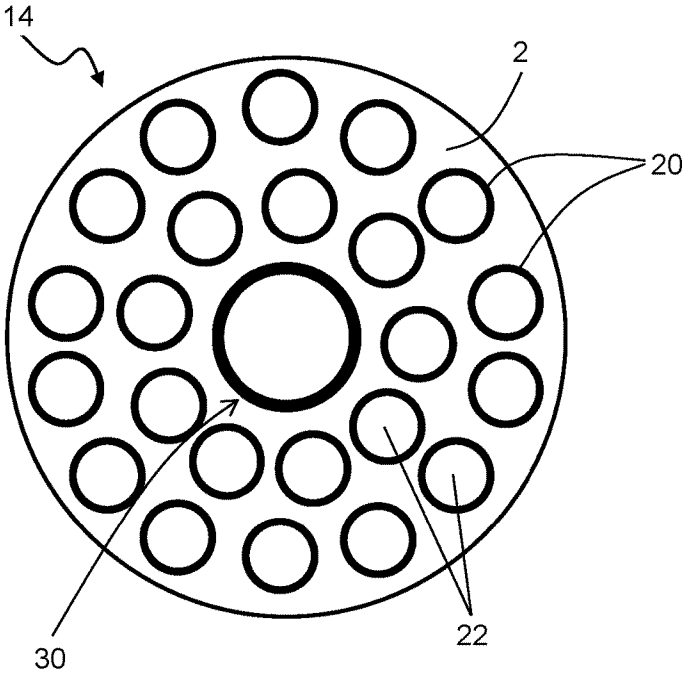
-- FIG. 4 --
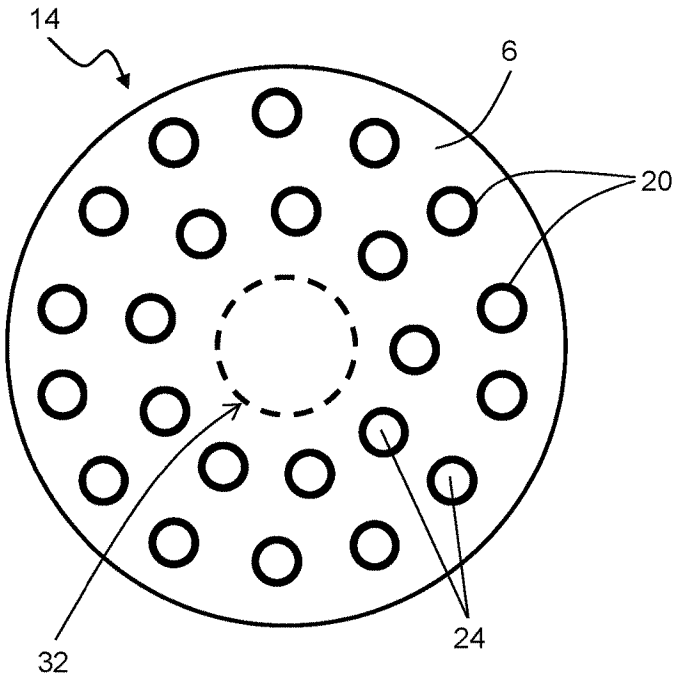
-- FIG. 5 --

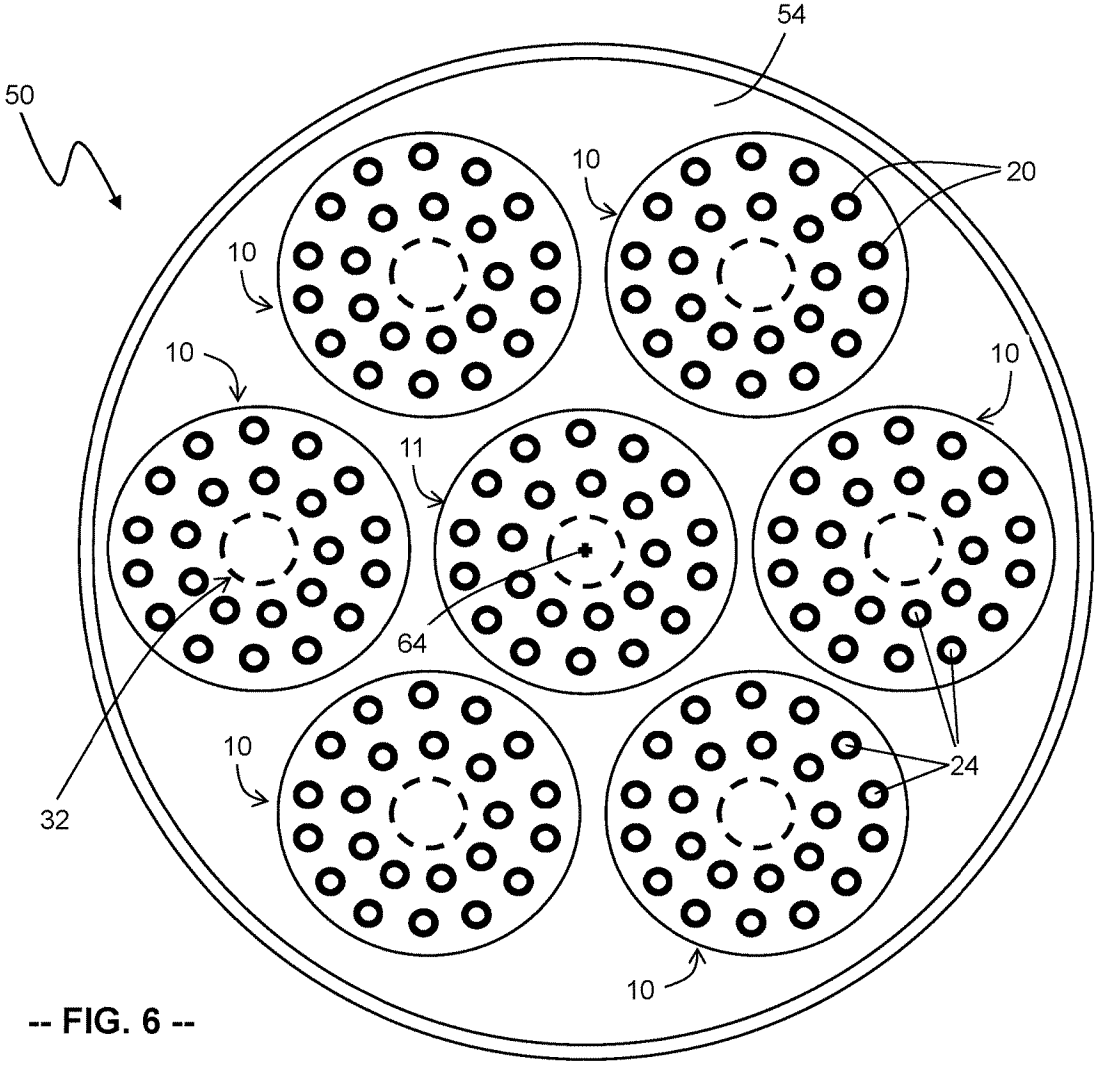
-- FIG. 6 --

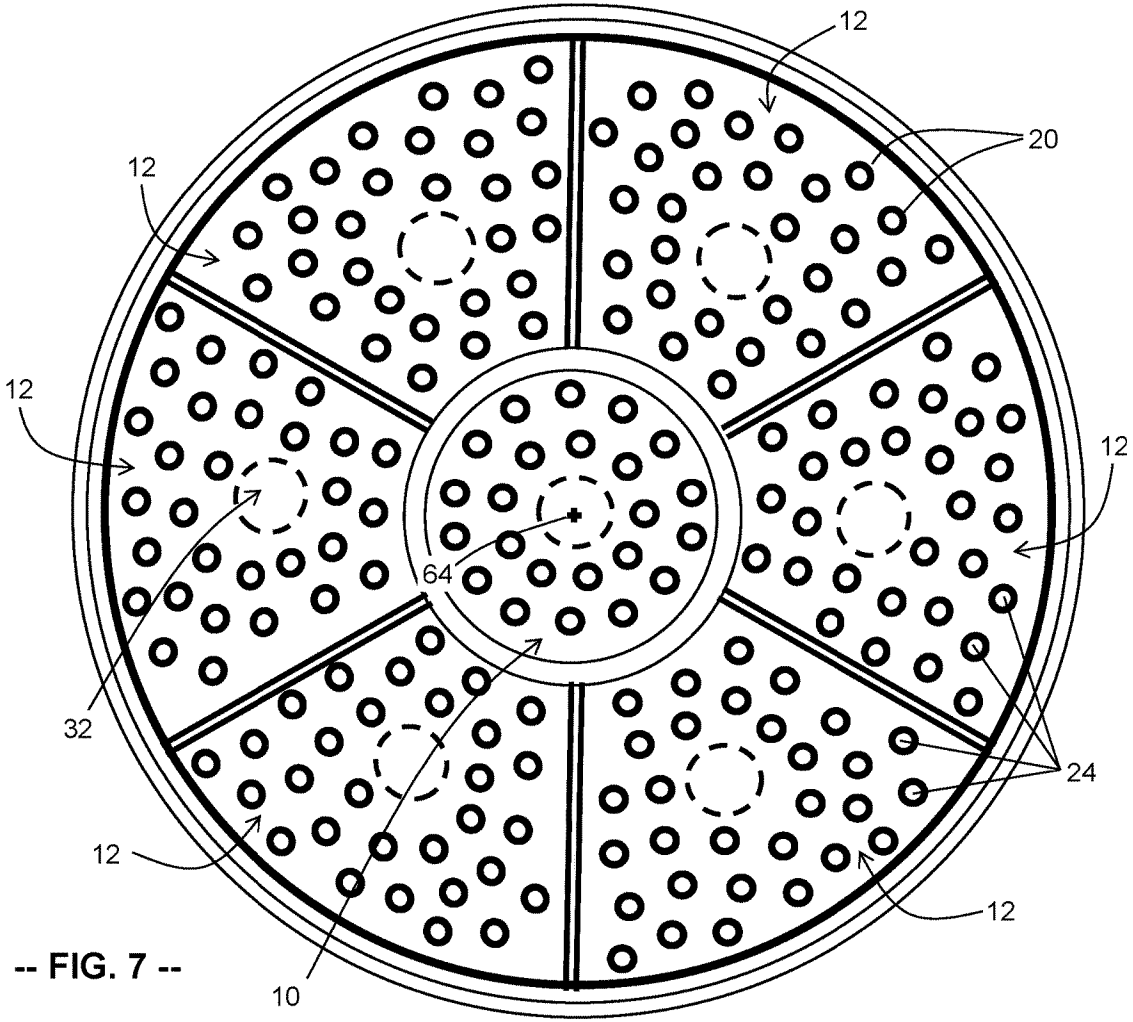
-- FIG. 7 --

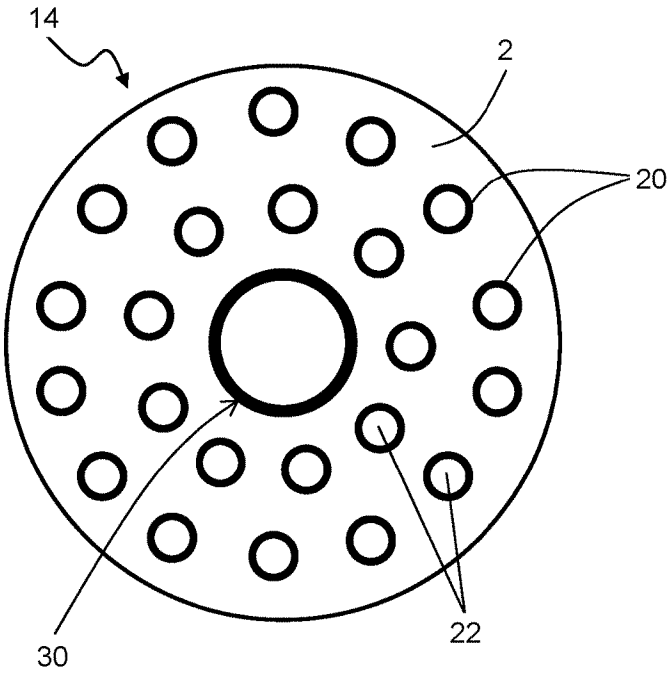
-- FIG. 8 --
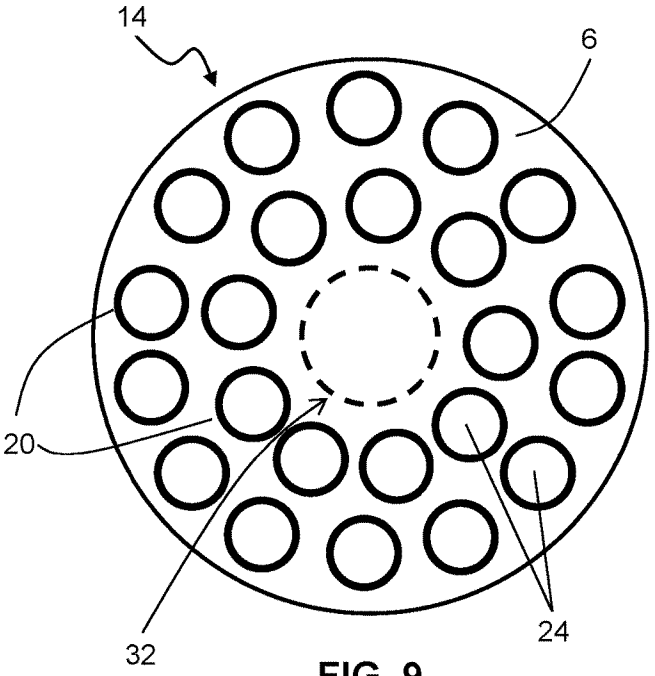
-- FIG. 9 --

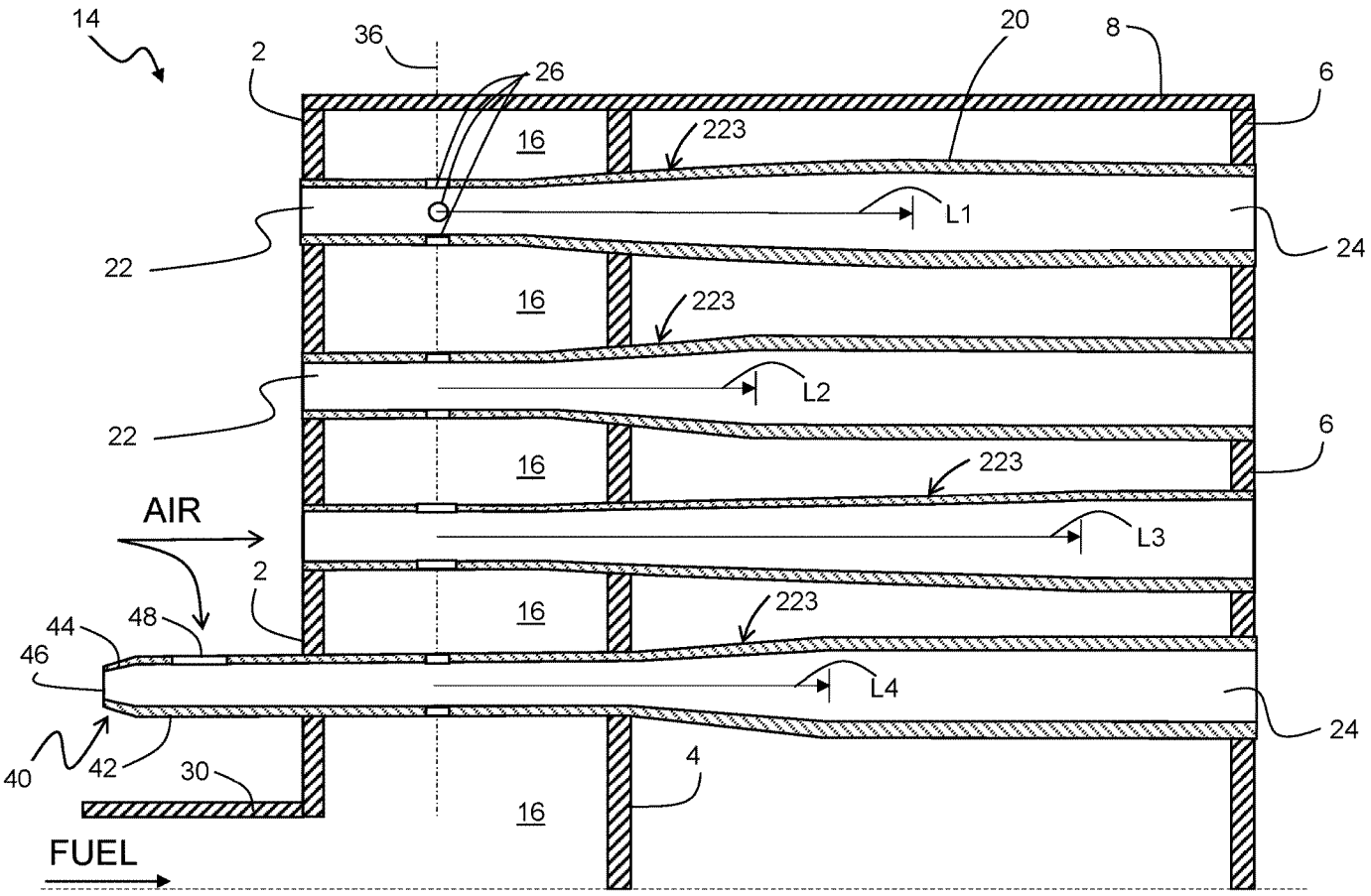
-- FIG. 10 --

COMPACT MULTI-RESIDENCE TIME BUNDLED TUBE FUEL NOZZLE HAVING TRANSITION PORTIONS OF DIFFERENT LENGTHS

FEDERAL RESEARCH STATEMENT

This invention was made with support of the U.S. Government under contract number DE-FE0023965, which was awarded by the Department of Energy. The Government has certain rights under this invention.

TECHNICAL FIELD

The present disclosure is related to a fuel nozzle for a gas turbine combustor. More specifically, the present disclosure is directed to a bundled tube fuel nozzle having a compact shape and having a configuration to produce multiple residence times from the same fuel nozzle.

BACKGROUND

Combustors are commonly used in industrial and commercial operations to ignite fuel to produce combustion gases having a high temperature and pressure. For example, gas turbines and other turbo-machines typically include one or more combustors to generate power or thrust. A typical gas turbine used to generate electrical power includes an axial compressor at the front, multiple combustors around the middle, and a turbine at the rear. Ambient air enters the compressor as a working fluid, and the compressor progressively imparts kinetic energy to the working fluid to produce a compressed working fluid at a highly energized state. The compressed working fluid exits the compressor and flows through one or more fuel nozzles in the combustors where the compressed working fluid mixes with fuel before igniting to generate combustion gases having a high temperature and pressure. The combustion gases flow to the turbine where they expand to produce work. For example, expansion of the combustion gases in the turbine may rotate a shaft connected to a generator to produce electricity and/or connected to the compressor to compress air.

Various factors influence the design and operation of the combustors. For example, higher combustion gas temperatures generally improve the thermodynamic efficiency of the combustors. However, higher combustion gas temperatures generally increase the dissociation rate of diatomic nitrogen, increasing the production of nitrogen oxides (NOx). Conversely, a lower combustion gas temperature associated with reduced fuel flow and/or part load operation (turndown) generally reduces the chemical reaction rates of the combustion gases, increasing the production of carbon monoxide and unburned hydrocarbons.

At particular operating conditions, some combustors may produce combustion instabilities that result from an interaction or coupling of the combustion process or flame dynamics with one or more acoustic resonant frequencies of the combustor. For example, one mechanism of combustion instabilities may occur when the acoustic pressure pulsations cause a mass flow fluctuation at a fuel port which then results in a fuel-air ratio fluctuation in the flame. When the resulting fuel/air ratio fluctuation and the acoustic pressure pulsations have a certain phase behavior (e.g., in-phase or approximately in-phase), a self-excited feedback loop results. This mechanism, and the resulting magnitude of the combustion dynamics, depends on the time between the injection of the fuel and the time when it reaches the flame zone, known in the art as "residence time" or "mixing residence time" (Tau, or T). Generally, there is an inverse relationship between residence time and frequency: that is, as the residence time increases, the frequency of the combustion instabilities decreases; and when the residence time decreases, the frequency of the combustion instabilities increases.

It has been observed that, in some instances, combustion dynamics may reduce the useful life of one or more combustor and/or downstream components. For example, the combustion dynamics may produce pressure pulses inside the fuel nozzles and/or combustion chambers that may adversely affect the high cycle fatigue life of these components, the stability of the combustion flame, the design margins for flame holding, and/or undesirable emissions.

Combustors having bundled tube fuel nozzles may experience these kinds of combustion dynamics. Previously, efforts to mitigate this problem have sought to offset the plane of fuel injection holes in some of the individual tubes within the fuel nozzle (or within the combustor head end) from the plane of the fuel injection holes in other tubes. As a result, to achieve significant difference in the residence times, the length of the tubes has been increased to accommodate multiple axially offset fuel injection planes. Such an assembly is described, for example, in U.S. Pat. No. 9,151,502.

SUMMARY

According to a first aspect, a fuel nozzle includes a first plate, a second plate axially spaced from the first plate, a shroud extending between the first plate and the second plate, thereby defining a plenum. A plurality of tubes extends through the first plate, the plenum, and the second plate. An inlet of each tube is defined through the first plate, an outlet of each tube is located downstream of the second plate, and a fuel injection port is defined through the tube, the fuel injection port being in fluid communication with the plenum. The tube inlets have a first size, the tube outlets have a second size different from the first size, and the walls defining the tubes have a transition portion between the inlet and the outlet. The transition portion has an axial length from the fuel injection port to a location having a diameter of the second size. The transition portion of a first tube extends a first axial length, and the transition portion of a second tube extends a different second axial length.

According to another aspect, a fuel nozzle includes a first plate, a second plate axially spaced from the first plate, a shroud extending between the first plate and the second plate, thereby defining a plenum. A plurality of tubes extends through the first plate, the plenum, and the second plate. At least one tube of the plurality of tubes extends upstream of the first plate and has an inlet upstream of the first plate, and at least one other tube of the plurality of tubes has an inlet defined through the first plate. Each tube has an outlet located downstream of the second plate and a fuel injection port in fluid communication with the plenum. The inlet of the at least one other tube has a first size, and the outlet of each tube of the plurality of tubes has a second size different from the first size. The wall defining each tube of the plurality of tubes has a transition portion between the inlet and the outlet, the transition portion having an axial length from the inlet to a location having a diameter of the second size. The transition portion of a first tube of the plurality of tubes extends a first axial length, and the transition portion of a second tube of the plurality of tubes extends a different second axial length.

In one embodiment, the first size is larger than the second size, and the transition portion is a converging portion. In another embodiment, the first size is smaller than the second size, and the transition portion is a diverging portion.

BRIEF DESCRIPTION OF THE DRAWINGS

These and other features, aspects, and advantages of the present embodiment will become better understood when the following detailed description is read with reference to the accompanying drawings, in which:

FIG. 1 is a perspective view of an exemplary bundled tube fuel nozzle, as described herein;

FIG. 2 is a schematic cross-sectional view of a bundled tube fuel nozzle, according to the prior art;

FIG. 3 is a schematic cross-sectional view of a portion of the bundled tube fuel nozzle of FIG. 1;

FIG. 4 is a schematic view of an inlet (upstream) end of the bundled tube fuel nozzle of FIG. 1;

FIG. 5 is a schematic view of an outlet (downstream) end of the bundled tube fuel nozzle of FIG. 1;

FIG. 6 is a schematic plan view of a combustor head end, including the bundled tube fuel nozzle of FIG. 1;

FIG. 7 is a schematic plan view of a combustor head end, in which the bundled tube fuel nozzle is configured as a sector-shaped fuel nozzle;

FIG. 8 is a schematic view of an inlet (upstream) end of an alternate bundled tube fuel nozzle;

FIG. 9 is a schematic view of an outlet (downstream) end of the alternate bundled tube fuel nozzle of FIG. 8; and FIG. 10 is a schematic cross-sectional view of a portion of the alternate bundled tube fuel nozzle of FIGS. 8 and 9.

DETAILED DESCRIPTION

The written description uses examples to disclose various aspects and features of the present compact multi-residence time fuel nozzle. The written description, which includes a description of the best mode, is intended to enable any person skilled in the art to practice the improvements described herein, including making and using any devices and systems and performing any incorporated methods. The patentable scope of the improvements is defined by the claims and may include other examples that occur to those skilled in the art. Such other examples are intended to fall within the scope of the claims if they have structural elements that do not differ from the literal language of the claims or if they include equivalent structural elements with insubstantial differences from the literal language of the claims.

When introducing elements of various embodiments, the articles "a", "an", and "the" are intended to mean that there are one or more of the elements. The terms "comprising," "including," and "having" are intended to be inclusive and mean that there may be additional elements other than the listed elements.

FIG. 1 illustrates an exemplary bundled tube fuel nozzle 10, according to a first aspect provided herein. Specifically, the nozzle 10 includes a fuel nozzle base 28 and a fuel injection head 14 connected by a centrally-located fuel supply tube 30. The fuel injection head 14 is attached to the downstream end 18 of the fuel supply tube 30, with the leading edge of the fuel supply tube 30 being connected within the center of the fuel injection head 14.

It will be appreciated that multiple fuel nozzles 10 are typically arranged within a single combustor to supply a mixture of fuel and air to a respective combustion chamber. Typically, the nozzle bases 28 in each combustor are fixed to a combustor end cover and the fuel injection heads 14 are fixed to a forward cap assembly (see FIG. 6, for example) within the combustion chamber.

As used herein, the terms "upstream" and "downstream" are directional terms used to describe the location of components relative to the flow of air (or a fuel/air mixture) through the present bundled tube fuel nozzle from an upstream end to a downstream end. Upstream components are located closer to the fuel supply tube 30, the combustor end cover, and, ultimately, the compressor section, while downstream components are located on or toward a cap face 54 of the combustor (sometimes a cooling plate), the combustion zone, and, ultimately, the turbine section.

The fuel injection head 14 is formed as an enclosed, generally hollow structure having an upstream plate 2, a downstream plate 6 opposite the upstream plate 2, and a shroud 8 extending between the upstream plate 2 and the downstream plate 6 and extending circumferentially around a longitudinal axis through the fuel supply line 30. The shroud 8 may be described as annular peripheral wall about an individual fuel nozzle 10. As shown in more detail in FIG. 3, an intermediate plate 4 is positioned between the upstream plate 2 and the downstream plate 6. The upstream plate 2, the intermediate plate 4, and the shroud 8 define a fuel plenum 16, which is in fluid communication with the fuel supply tube 30.

While the shroud 8 is illustrated as having a circular shape, it should be appreciated that the shroud 8 may define any suitable shape having curved sides, straight sides, or a combination of straight and curved sides. For example, the bundled tube fuel nozzle 10 may have a circular shape (as shown in FIGS. 1 and 6), a square shape, a hexagonal shape, a sector shape having straight and curved sides (as shown in FIG. 7), or any other suitable shape.

A plurality of tubes 20 extend through the fuel plenum 16, generally from the upstream plate 2 to the downstream plate 6. Each tube 20 has at least one fuel injection port 26, which is in fluid communication with the fuel plenum 16.

In a fuel injection head 114 of a conventional bundled tube fuel nozzle, as shown schematically in FIG. 2, a plurality of premixing tubes 120 extend from an upstream plate 102, through an intermediate plate 104, and to a downstream plate 106. The tubes 120 are surrounded by a shroud 108 that extends between the upstream plate 102 and the downstream plate 106, such that a fuel plenum 116 is formed by the upstream plate 102, the intermediate plate 104, and the shroud 108. The fuel plenum 116 is in fluid communication with a fuel supply tube 130. Fuel from the fuel supply tube 130 is directed inward through one or more fuel injection ports 126 defined through the wall of each premixing tube 120. Within the premixing tube 120, the fuel mixes with air, which enters through an inlet 122 of the premixing tube 120, and a mixture of fuel and air exits the premixing tube 120 via an outlet 124 at the downstream plate 106. In this configuration, each of the premixing tubes 120 has a uniform length and a uniform cross-sectional diameter from the inlet 122 to the outlet 124, and each of the premixing tubes 120 provides the fuel/air mixture with the same residence time from the fuel injection port(s) 126 to the outlet 124.

A portion of the fuel injection head 14 of the present fuel nozzle 10 is shown in more detail in FIG. 3. As described above, the fuel injection head 14 includes the upstream plate 2, the intermediate plate 4, and the downstream plate 6. The shroud 8 extends between the upstream plate 2 and the downstream plate 6, in the illustrated embodiment. The upstream plate 2, the intermediate plate 4, and the shroud 8 define the fuel plenum 16, which is in fluid communication with the fuel supply tube 30.

The premixing tubes 20 extend between the upstream plate 2 and the downstream plate 6, thus extending through the fuel plenum 16. Each of the premixing tubes 20 has at least one fuel injection port 26 in fluid communication with the fuel plenum 16 for receiving fuel from the fuel plenum 26. As shown in the exemplary embodiment of FIG. 3, the fuel injection ports 26 are aligned along a common axial injection plane 36. In other embodiments (not shown), the fuel injection ports 26 may be located in two or more axial injection planes 36, although such an arrangement necessitates greater care to maintain multiple residence times.

It should be understood that the number and size of the fuel injection ports 26 may be selected based on the inlet diameter of the premixing tubes 20 and the velocity of the air flowing through the inlets 22. For example, as the size of the premixing tubes 20 increases (at the inlets 22), the number of fuel injection ports 26 and/or the size of the fuel injection ports 26 increases as well to achieve the desired fuel/air ratio and degree of mixedness.

Each premixing tube 20 further includes a transition portion 23 located between the inlet 22 and the outlet 24. In this embodiment, the transition portion 23 is a converging portion. To produce the multi-residence time fuel nozzle 10, as described, the transition portions 23 of the respective tubes 20 have different axial lengths (e.g., $L_1$, $L_2$, $L_3$, and $L_4$) between the axial injection plane 36 and the plane at which the tube 20 has a cross-sectional diameter equal, or substantially equal, to the cross-sectional diameter of the outlet 24. As shown in FIG. 3, fuel and air mixed in the tube 20 having a transition portion 23 of length $L_2$ experience the shortest residence time, while fuel and air mixed in the tube 20 having a transition portion 23 of length $L_3$ experience the longest mixing time. It is contemplated that the fuel injection head 14 may be provided with a plurality of tubes 20 having transition portions 23 of multiple different lengths ($L_1$, $L_2$, . . . $L_n$, where n may or may not be equal to the number of individual tubes 20). It is not required, though it is possible with additive manufacturing techniques, to provide each tube 20 with a transition portion 23 having a unique length.

To further promote mixing of fuel and air within the premixing tubes, one or more tubes 20 may be outfitted with a forward extension 40. The forward extension 40 includes a wall portion 42 having a cross-sectional diameter equal, or substantially equal, to the cross-sectional diameter of the premixing tube 20 at its forward end. The wall portion 42 is connected to a conical portion 44. Based on the flow direction of air entering an extension inlet 46 of the conical portion 44, the conical portion 44 may be described as diverging from the extension inlet 46 toward the wall portion 42. Additionally, or alternately, to the extension inlet 46, one or more air slots 48 may be defined through the wall portion 42 to introduce a cross-flow that generates vortices within the forward extension 40 and, subsequently, the premixing tube 20. Such vortices promote greater mixing.

FIG. 4 is a schematic representation of the fuel injection head 14, as shown from the upstream plate 2. The fuel supply tube 30 is centrally located in the fuel injection head 14, though not required. The premixing tubes 20 surround the fuel supply tube 30, and, as described above, the inlets 22 receive air for mixing with fuel inside the premixing tubes 20.

FIG. 5 is a schematic representation of the fuel injection head 14, as shown from the downstream plate 6. The premixing tubes 20 surround a void area 32, which is axially aligned with the fuel supply tube 30. The outlets 24 of the premixing tubes 20 introduce the fuel/air mixture to a combustion zone for burning.

As will be noted from comparison of FIGS. 4 and 5, the inlets 22 of the premixing tubes 20 have a uniform cross-sectional diameter of a first size, and the outlets 24 of the premixing tubes 20 have a uniform cross-sectional diameter of a second size smaller than the first size. By having the outlets 24 of the premixing tubes 20 have a smaller diameter than the inlets 22, the flow of the fuel and air through the premixing tubes 20 is accelerated. Additionally, ensuring that the outlets 24 of the premixing tubes 20 are of uniform size results in a uniform velocity of the fuel and air mixture entering the combustion zone.

Moreover, while the inlets 22 and the outlets 24 are illustrated as having a generally circular cross-section, it should be understood that other shapes may instead be used for the inlets 22 and/or the outlets 24. Additionally, while the premixing tubes 20 are illustrated as having a straight longitudinal axis from the inlets 22 to the outlets 24, it is contemplated that the longitudinal axis may instead be curved in some embodiments for some or all of the premixing tubes.

FIGS. 6 and 7 schematically illustrate a head end 50 of a combustor, which includes the cap face 54 and a plurality of bundled tube fuel nozzles 10 located within the cap face 54. In FIG. 6, the bundled tube fuel nozzles 10 have a circular shape, and are arranged in a six-around-one configuration, in which six outer fuel nozzles 10 surround a circular center fuel nozzle 11 that defines a longitudinal axis 64 of the combustor. In this arrangement, the cap face 54 is provided with openings (not shown) within which each fuel nozzle 10, 11 is mounted.

In FIG. 7, the outer fuel nozzles 12 have a sector shape having straight and curved sides, such that a greater percentage of the cap face 54 is occupied by premixing tubes 20. The sector-shaped fuel nozzles 12 are arranged circumferentially about a center fuel nozzle 11 that shares a common longitudinal axis with the longitudinal axis 64 of the combustor. In this configuration, the cap face 54 may be formed by the nesting of adjacent fuel nozzles 11, 12 (as shown), or the downstream plates 6 of the respective fuel nozzles 11, 12 may be replaced with a single, unitary plate that functions as the cap face 54. Such a unitary plate may be provided with a number of apertures therein, which corresponds to the number, location, and size of the premixing tubes 20 (the size of the apertures being appropriate for the size of the outlets 24 of the premixing tubes 20).

Thus, the present disclosure provides a compact bundled tube fuel nozzle having multiple residence times. The fuel nozzle mitigates combustion dynamics over a wide range of frequencies without the addition of resonators or quarter-wave tubes that themselves perform no mixing function. Moreover, the present fuel nozzle accomplishes multiple residence times in a uniform and compact package without the need for long tube lengths to accommodate multiple, axially spaced fuel injection planes. The present fuel nozzle may be manufactured as a single piece component using additive manufacturing techniques (such as three-dimensional printing) with the fuel injection ports 26 being designed into the print-build or being produced by electrical discharge machining (EDM) or other suitable drilling processes.

Many of these objectives may instead be accomplished by providing a fuel nozzle having a plurality of tubes, in which the tubes have inlets with a first uniform diameter at the upstream plate 2 and outlets with a second, larger diameter at the downstream plate 6, as shown in FIGS. 8, 9, and 10. FIG. 8 is a schematic representation of the fuel injection head 14 of the alternate fuel nozzle, as shown from the upstream plate 2. The fuel supply tube 30 is centrally located in the fuel injection head 14, though not required. The premixing tubes 20 surround the fuel supply tube 30, and, as described above, the inlets 22 receive air for mixing with fuel inside the premixing tubes 20.

FIG. 9 is a schematic representation of the fuel injection head 14 of the alternate bundled tube fuel nozzle, as shown from the downstream plate 6. The premixing tubes 20 surround a void area 32, which is axially aligned with the fuel supply tube 30. The outlets 24 of the premixing tubes 20 introduce the fuel/air mixture to a combustion zone for burning.

As will be noted from comparison of FIGS. 8 and 9, the inlets 22 of the premixing tubes 20 have a uniform cross-sectional diameter of a first size, and the outlets 24 of the premixing tubes 20 have a uniform cross-sectional diameter of a second size different from the first size. In this embodiment, the outlets 24 of the premixing tubes 20 have a larger diameter than the inlets 22. As discussed above, ensuring that the outlets 24 of the premixing tubes 20 are of uniform size results in a uniform velocity of the fuel and air mixture entering the combustion zone.

Moreover, while the inlets 22 and the outlets 24 are illustrated as having a generally circular cross-section, it should be understood that other shapes may instead be used for the inlets 22 and/or the outlets 24. Additionally, while the premixing tubes 20 are illustrated as having a straight longitudinal axis from the inlets 22 to the outlets 24 (as shown in FIG. 10), it is contemplated that the longitudinal axis may instead be curved in some embodiments for some or all of the premixing tubes.

A portion of the fuel injection head 14 of the alternate bundled tube fuel nozzle described with reference to FIGS. 8 and 9 is shown in more detail in FIG. 10. As described above, the fuel injection head 14 includes the upstream plate 2, the intermediate plate 4, and the downstream plate 6. The shroud 8 extends between the upstream plate 2 and the downstream plate 6, in the illustrated embodiment. The upstream plate 2, the intermediate plate 4, and the shroud 8 define the fuel plenum 16, which is in fluid communication with the fuel supply tube 30 (not shown in FIG. 10).

The premixing tubes 20 extend between the upstream plate 2 and the downstream plate 6, thus extending through the fuel plenum 16. Each of the premixing tubes 20 has at least one fuel injection port 26 in fluid communication with the fuel plenum 16 for receiving fuel from the fuel plenum 26. As shown in the exemplary embodiment of FIG. 10, the fuel injection ports 26 are aligned along a common axial injection plane 36. In other embodiments (not shown), the fuel injection ports 26 may be located in two or more axial injection planes 36, although such an arrangement necessitates greater care to maintain multiple residence times.

In this embodiment, each premixing tube 20 further includes a transition portion 223 that diverges between the inlet 22 and the outlet 24. To produce the multi-residence time fuel nozzle 10, as described, the diverging transition portions 223 of the respective tubes 20 have different axial lengths (e.g., $L_1$, $L_2$, $L_3$, and $L_4$) between the axial injection plane 36 and the plane at which the tube 20 has a cross-sectional diameter equal, or substantially equal, to the cross-sectional diameter of the outlet 24. As shown in FIG. 10, fuel and air mixed in the tube 20 having a diverging transition portion 223 of length $L_2$ experience the shortest residence time, while fuel and air mixed in the tube 20 having a diverging transition portion 223 of length $L_3$ experience the longest mixing time. It is contemplated that the fuel injection head 14 may be provided with a plurality of tubes 20 having diverging transition portions 223 of multiple different lengths ($L_1$, $L_2$, . . . , $L_n$, where n may or may not be equal to the number of individual tubes 20). It is not required, though it is possible with additive manufacturing techniques, to provide each tube 20 with a diverging transition portion 223 having a unique length.

To further promote mixing of fuel and air within the premixing tubes, one or more tubes 20 may be outfitted with a forward extension 40. The forward extension 40 includes a wall portion 42 having a cross-sectional diameter equal, or substantially equal, to the cross-sectional diameter of the premixing tube 20 at its forward end. In this embodiment, the wall portion 42 has a cross-sectional diameter smaller than the diameter at the outlet 24. The wall portion 42 is connected to a conical portion 44. Based on the flow direction of air entering an extension inlet 46 of the conical portion 44, the conical portion 44 may be described as diverging from the extension inlet 44 toward the wall portion 42. Additionally, or alternately, to the extension inlet 42, one or more air slots 48 may be defined through the wall portion 42 to introduce a cross-flow that generates vortices within the forward extension 40 and, subsequently, the premixing tube 20. Such vortices promote greater mixing.

While the invention has been described in terms of various specific embodiments, those skilled in the art will recognize that the invention can be practiced with modification within the spirit and scope of the claims.

What is claimed is:

1. A fuel nozzle, comprising:

a first plate, a second plate axially spaced from the first plate, a shroud extending between the first plate and the second plate, such that the first plate, the second plate, and the shroud define a plenum therein;

a third plate axially downstream from the second plate; and a plurality of tubes extending through the first plate, the plenum, the second plate, and the third plate, such that an inlet of each tube is defined through the first plate, an outlet of each tube is defined in a common plane with the third plate, and a fuel injection port is defined through each tube, the fuel injection port being in fluid communication with the plenum;

wherein the inlet of each tube of the plurality of tubes has a first diameter having a first size, the outlet of each tube of the plurality of tubes has a second diameter having a second size different from the first size, and a wall defining each tube of the plurality of tubes has a transition portion between the inlet and the outlet, the transition portion having a diameter transitioning from the first size to the second size and having an axial length from the fuel injection port to a location having a diameter of the second size, the location having the diameter of the second size being upstream of the third plate; and wherein the transition portion of a first tube of the plurality of tubes extends a first axial length and the transition portion of a second tube of the plurality of tubes extends a different second axial length.

2. The fuel nozzle of claim 1, wherein the first size is larger than the second size, and the transition portion is a converging portion.

3. The fuel nozzle of claim 1, wherein the first size is smaller than the second size, and the transition portion is a diverging portion.

4. The fuel nozzle of claim 1, further comprising a fuel supply tube, the fuel supply tube being in fluid communication with the plenum.

5. The fuel nozzle of claim 1, wherein the fuel injection holes of the plurality of tubes are aligned axially along a common fuel injection plane among all of the plurality of tubes.

6. The fuel nozzle of claim 1, wherein the fuel injection port of each tube is one of a plurality of fuel injection ports of each tube.

7. The fuel nozzle of claim 6, wherein the first tube has a first number of fuel injection ports and the second tube has a different second number of fuel injection ports.

8. The fuel nozzle of claim 6, wherein the fuel injection ports in the first tube have a first fuel injection port size and the fuel injection ports in the second tube have a different second fuel injection port size.

9. The fuel nozzle of claim 1, wherein each tube of the plurality of tubes has a tube length, and wherein the tube length of each tube is uniform.

10. The fuel nozzle of claim 1, wherein the transition portion of a first tube of the plurality of tubes has a different axial length from the transition portion of a second tube of the plurality of tubes.

11. The fuel nozzle of claim 1, wherein each tube of the plurality of tubes has a longitudinal axis circumscribed by the wall, the longitudinal axis of each tube being a straight line.

12. The fuel nozzle of claim 1, wherein the shroud extends between the first plate and the third plate.

13. A fuel nozzle, comprising:

a first plate, a second plate axially spaced from the first plate, a shroud extending between the first plate and the second plate, such that the first plate, the second plate, and the shroud define a plenum therein;

a third plate axially downstream from the second plate; and a plurality of tubes extending through the first plate, the plenum, the second plate, and the third plate, such that at least one first tube of the plurality of tubes extends upstream of the first plate and has a first inlet upstream of the first plate, and at least one second tube of the plurality of tubes has a second inlet defined through the first plate;

wherein each tube has an outlet defined in a common plane with the third plate and at least one fuel injection port defined through the tube, the fuel injection port being in fluid communication with the plenum;

wherein the second inlet of the at least one second tube has a first size, the outlet of each tube of the plurality of tubes has a second size different from the first size, and a wall defining each tube of the plurality of tubes has a transition portion between the inlet and the outlet, the transition portion having a diameter transitioning from the first size to the second size and having an axial length from the fuel injection port to a location having a diameter of the second size, the location having the diameter of the second size being upstream of the third plate; and wherein the transition portion of one tube of the plurality of tubes extends a first axial length and the transition portion of another tube of the plurality of tubes extends a different second axial length.

14. The fuel nozzle of claim 13, wherein the first size is larger than the second size, and the transition portion is a converging portion.

15. The fuel nozzle of claim 13, wherein the first size is smaller than the second size, and the transition portion is a diverging portion.

16. The fuel nozzle of claim 13, wherein the wall of the at least one first tube includes an extension portion extending between the first inlet and the first plate; and wherein the wall defines a slot therethrough in the extension portion.

17. The fuel nozzle of claim 16, wherein the extension portion defines a diverging portion from the inlet to the slot.

18. The fuel nozzle of claim 17, wherein the extension portion has a uniform cross-section from the slot to the first plate, the uniform cross-section having a diameter of the first size.

* * * * *